United States Patent [19]

Nagayoshi

[11] Patent Number: 4,850,330

[45] Date of Patent: Jul. 25, 1989

[54] DEVICE FOR SHOOTING BULLETS BY PRESSURE MEDIUM FOR USE IN A TOY GUN

[76] Inventor: Katsumi Nagayoshi, No. 2-5-23-1509, Shiohama Koutou-ku, Tokyo, Japan

[21] Appl. No.: 127,360

[22] Filed: Dec. 1, 1987

[51] Int. Cl.[4] ..... F41B 11/02

[52] U.S. Cl. ..... 124/76; 124/70; 124/72; 124/73; 124/50

[58] Field of Search ..... 124/70–74, 124/76, 56, 69, 50

[56] References Cited

U.S. PATENT DOCUMENTS

| | | | |
|---|---|---|---|
| 1,862,697 | 9/1932 | Mihalyi | 124/76 |
| 2,398,813 | 4/1946 | Swisher | 124/72 |
| 2,861,560 | 11/1958 | Alinari | 124/69 |
| 4,038,961 | 8/1977 | Olofsson | 124/76 |
| 4,304,213 | 12/1981 | Jereckos | 124/70 |

*Primary Examiner*—Randolph A. Reese
*Assistant Examiner*—Anthony Knight
*Attorney, Agent, or Firm*—Edwin E. Greigg

[57] ABSTRACT

This invention relates to a device for shooting bullets by pressure medium for use in a toy gun. This mechanism includes a piston member fitted into an outer tubular member and reciprocating in response to changes in the pressure medium, and wait hook arms are provided in the piston member. Further, an inner tubular body having a gas injection hole is fixedly provided within the outer tubular member, and a needle valve for opening and closing the injection hole is provided in association with the inner tubular body. This needle valve is provided with a weight biased by a spring member. The weight is disengaged from the wait hook arm by the advancing movement of the piston member and hits against the rear end portion of the needle valve. In addition, at the rear end portion of the needle valve, there is provided a seal valve for temporarily closing a gas introduction hole provided on the side of the rear end portion of the outer tubular member by hitting of the weight. When the piston member is returned to the initial position, this seal valve is opened as a result of the fact that a push rod provided at the piston member disengages a locking piece which is holding the needle valve.

4 Claims, 8 Drawing Sheets

(PRIOR WORK)

DEVICE FOR SHOOTING BULLETS BY PRESSURE MEDIUM FOR USE IN A TOY GUN

BACKGROUND OF THE INVENTION

This invention relates to a device for shooting bullets by pressure medium for use in a toy gun, which is adapted to shoot bullets in succession by making use of a pressure medium, e.g., carbonic acid gas, or propane or liquefied petroleum gas, etc.

As a conventional implementation, the inventor has set forth a shooting device in application Ser. No. 61-128687, filed June 3, 1986, now Pat. No. 62-288499, published Dec. 15, 1987 Japan.

Namely, FIG. 2 set forth herein is the same as FIG. 7 illustrated in said Japanese application, but shown with different reference characters. The device shown by FIG. 2 herein is a device 3 for shooting a bullet 2 by a pressure medium 1 for use in a toy gun comprises an outer tubular member 5 having a bullet introduction opening 4, a piston member 6 fitted into the outer tubular member 5 and reciprocating in response to changes in the pressure medium 1, a weight 8 associated with a needle valve 7 so as to be in engagement with the piston member 6 and out of engagement therewith and biased by a spring member 13 so as to strike against the needle valve 7. A packing member 9 is fitted into the outer tubular member 5 and adapted to receive a bullet 2 when opening 4 is opened by movement of end **6*a* to the right. The bullet, when received by packing member 9, is in a condition to be fired when the bullet introduction opening 4 is closed by the tip portion 6*a* of the piston member 6**.

With the above-mentioned structure, however, the pressure medium 1 freely flows in from a gas introduction hole 10 formed in the rear wall of the outer tubular member 5. Thus, the pressure medium 1 always will be delivered to the backward side of a chamber accommodating section 11 of the outer tubular member 5 after the bullet 2 has been shot, as shown in the drawing.

Accordingly, if a setting is not made such that a time period during which the needle valve 7 is opened is sufficient so as to permit the returning process of the piston member 6, there will occur a situation such that the piston member 6 cannot be completely returned beyond the bullet introduction opening initial position by the biasing force of a first spring member 12.

For example, in a case where the spring force of a third spring member 13 is weak and the weight 8 is light, the needle valve 7 cannot be opened, or only for a time such as several one hundredths of a second, even in the presence of the collision of the weight 8. Accordingly, the piston member 6 fails to return to the bullet introduction open position during such a short period. As a result, the needle valve 7 is closed by the spring force of the second spring member 14 wound onto the back end portion of the needle valve 7 in the course of its return. Thus, the internal pressure of the chamber accommodating section 11 is raised by the pressure medium 1, which continues to flow from a gas cylinder 16 into the outer tubular member 5 through a supply hose 15. As a result, the piston member 6 begins advancing for a second time in its course of return.

At this time, the elastic or resilient weight hook arm 17 provided at the piston member 6 is out of engagement with the weight 8. In a short time, approximately at the time when the internal pressure of the outer tubular member 5 and the gas pressure of the pressure medium 1 flowing thereinto balance with each other, all movement of the respective members is stopped. This results in the drawback that a situation is brought about such that the second bullet and those subsequent thereto cannot be continuously shot, although the first bullet has been shot.

SUMMARY OF THE INVENTION

A first object of the present invention is to temporarily close the gas introduction hole using a sealing valve when a bullet has been shot, thus allowing the piston member to securely return to the bullet initial introduction position.

Another object of the present invention is to allow respective members to be secured operatively even if the pressure of the pressure medium within the chamber accommodating section varies greatly, thus permitting bullets to be continuously shot.

A further object of the present invention is to allow the device to be made economically, be of a small size and light to handle.

A still further object of the present invention is to close the bullet introduction opening so that it is in a sealed condition by the tip portion of the piston member at the time of shooting a bullet, thus making it possible to freely design the shape of the magazine, and to prevent a situation such that a bullet is unable to be shot due to leakage of the gas pressure at the magazine.

A still further object of the present invention is to make it easy to manufacture respective members and to simplify the combination thereof.

To achieve these objects, in accordance with the present invention, there is provided a device for shooting bullets by a pressure medium for use in a toy gun, comprising a piston member fitted within an outer tubular member and reciprocating in response to changes in the pressure medium, an inner tubular body fixedly provided within a chamber accommodating section of the outer tubular member, a needle valve provided within the chamber accommodating section so as to permit a gas injection hole of the inner tubular body to be opened and closed, a weight provided at the piston member, and a sealing valve provided at the back end portion of the needle valve and arranged to momentarily close a gas introduction hold in response to the striking of the weight.

BRIEF DESCRIPTION OF THE DRAWINGS

FIG. 3 further shows the bullet initial introduction condition, at which time the piston member is withdrawn to the side of the rear wall of the outer tubular member, whereby the push rod 39 releases the locking piece 38. FIG. 4 shows a condition where the needle valve tip **32*a* closes the injection hole of the inner tubular body, whereby the seal valve 43 releases the sealing operation of the gas introduction hole. FIG. 5 shows a condition where piston member 30*d* is advanced, whereby the push rod is away from the locking piece 38. FIG. 6** shows a condition where piston member 30*a* closes the bullet introduction section, the weight 33 hits against the back end of the needle valve 32, and a bullet set at the packing member has been shot. FIG. 7 shows the condition whereby the seal valve 43 seals the gas introduction hole 28 as a result of the fact that the needle valve is withdrawn, and the locking piece temporarily stops the movement of the needle valve.

DETAILED DESCRIPTION OF THE DRAWINGS

Figure 1:
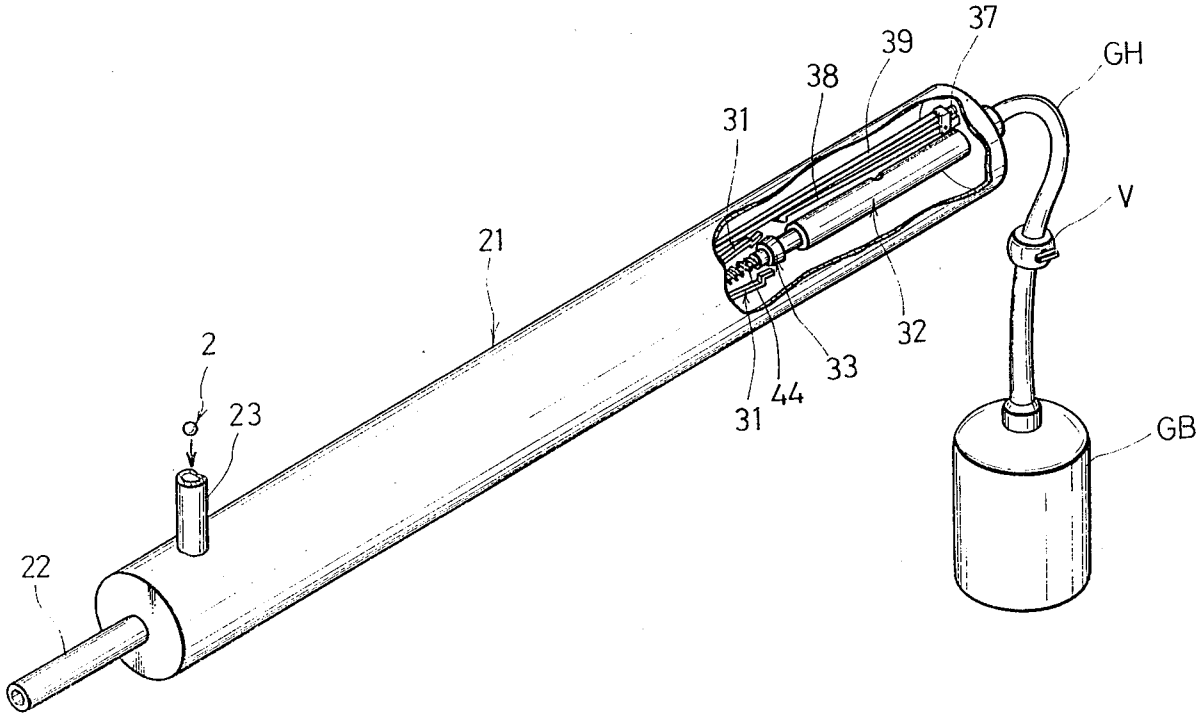
FIG. 1 is a generally perspective view of the gun with a part of a wall cut away.

FIG. 1 is a perspective view showing the entirety of the invention. Reference numeral 21 denotes an outer tubular member forming the body portion in the form of a machine gun. FIGS. 3 through 7 are cross-sectional views showing the essential parts of an embodiment according to the present invention wherein respective figures show the mode of operation. At the front end of the outer tubular member 21, a gun barrel 22 is integrally provided in a length direction of the outer tubular member 21. Reference numeral 23 denotes a bullet introduction section provided contiguously to a magazine (not shown) provided at the front end of the outer tubular member 21 so as to intersect therewith. In the bullet introduction section 23, a bullet introduction opening 23*a* communicating with the magazine and a bullet passageway 22*a* is formed. Reference numeral 24 denotes a chamber accommodating section formed within the outer tubular member 21, which communicates with the bullet introduction opening 23*a* and the bullet passageway 22*a* via a tubular body 26. Various members which will be described later are fitted into the chamber section 24. At the central portion of the chamber section 24, the inner tubular body 26 having a gas injection hole 26*a* is provided, and this body is supported in a floating condition by means of supports 25, which fixedly attach inner tubular body 26 to the inner wall of the outer tubular member 21.

Reference numeral 27 is a gas introduction section formed at the back end portion of the outer tubular member 21 and having a gas introduction hole 28 communicating with the chamber accommodating section 24. This gas introduction section 27 comprises a fitting portion 27*a* which projects out of the back wall and to which a gas supply hose GH, which is connected to a gas cylinder GB, is attached. Reference numeral 30 denotes a reciprocal piston member provided with the outer tubular member 21, and this piston moves in response to changes in a pressure medium G, such as carbonic acid gas, or propane gas, supplied from the gas cylinder GB. The piston member 30 comprises a piston tip portion 30*a* slidable along an inner wall of a guide hole formed in the outer tubular member on the back side of the bullet introduction opening 23*a*. A large diameter piston portion 30*d* is connected to the piston tip portion 30*a* through an offset 30*c* and is slidable along an inner peripheral wall 24*a* of the chamber section 24. A fitting portion 30*e* having a diameter smaller than that of piston portion 30*d*, which is provided contiguously to the back side of the large diameter slide 30*d*, is provided with two slender elastic or resilient hook arms 31, the terminal ends of which are adapted to engage a weight 33 fitted about a first needle valve 32 provided on the back side of the chamber 24.

Figure 4:
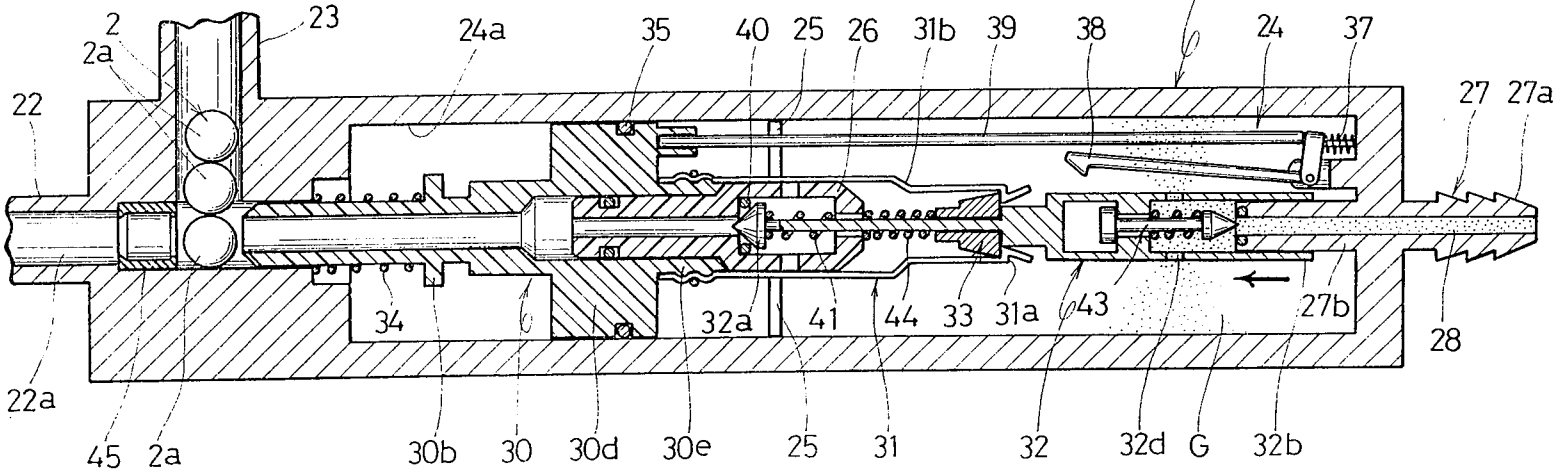

Each hook arm 31 is formed in the middle portion thereof with a bent portion 31*b*, which is arranged to contact an outer peripheral tapered surface 32*g* formed at the back end of the inner tubular body 26 during operation. The back end portion of the hook arm 31 at the back of a fitting portion 31*a* widens outwardly. At a site closer to the offset 30*c* of the piston tip portion 30*a*, a flange portion 30*b* which receives a first spring member 34 wound onto the piston tip portion 30*a* is arranged to bias the piston member 30 backwardly. The large diameter slide portion 30*d* of the piston member 30 is sealed by a packing 35 so that no pressure medium G can leak toward the piston tip portion 30*a*. To the large diameter slide portion 30*d* of the piston member 30 is fixedly attached a slender push rod 30, which operates an L-shaped locking piece 38 that is pivotally supported on the inside surface of the outer tubular member 21 and is biased by means of a spring member 37. The first needle valve 32 is fitted within the chamber 24 and is biased by a second spring member 41, so that the needle-like tip portion 32*a* is adapted to be pressed against a sealing ring 40 provided within a needle valve chamber of the inner tubular body 26. The back end portion 32*b* is slidably fitted over a projection 27*b* of the gas introduction section 27. Within the back end portion 32*b*, a seal valve is adapted to close the gas introduction hole 28 so as to permit the piston member 30 to return to its original position. The small second needle valve 43 is adapted to be biased to the side of the gas introduction hole 28 by means of a spring member 42. A plurality of notched portions 32*d* are formed in portion 32*b* for discharge of the pressure medium G. The needle valve 32 has a rod-like portion 32*c* which slidably penetrates the weight 33. The weight 33 is interposed between an abutment 32*f* and a spring 44 and is biased in a rearward direction by that member. As shown in FIG. 4, the piston member 30 is adapted to engage the weight 33 by means of hook arms 31. A packing member 45 is adapted to receive the bullet 2 which is delivered from the magazine section 23. Thus, when the piston tip portion of the piston member 30 advances to close the magazine opening 23*a*, the bullet is in an operative position to be fired, as noted by further reference to FIGS. 5 and 6. The packing member 45 is made of a relatively soft rubber which is formed so as to permit only one bullet at a time to be delivered from the magazine to the barrel. The packaging member 45 is positioned at a postiion immediately in front of the magazine 23.

The operational mode of the present invention shown in FIGS. 3 through 7 will now be described.

Figure 3:
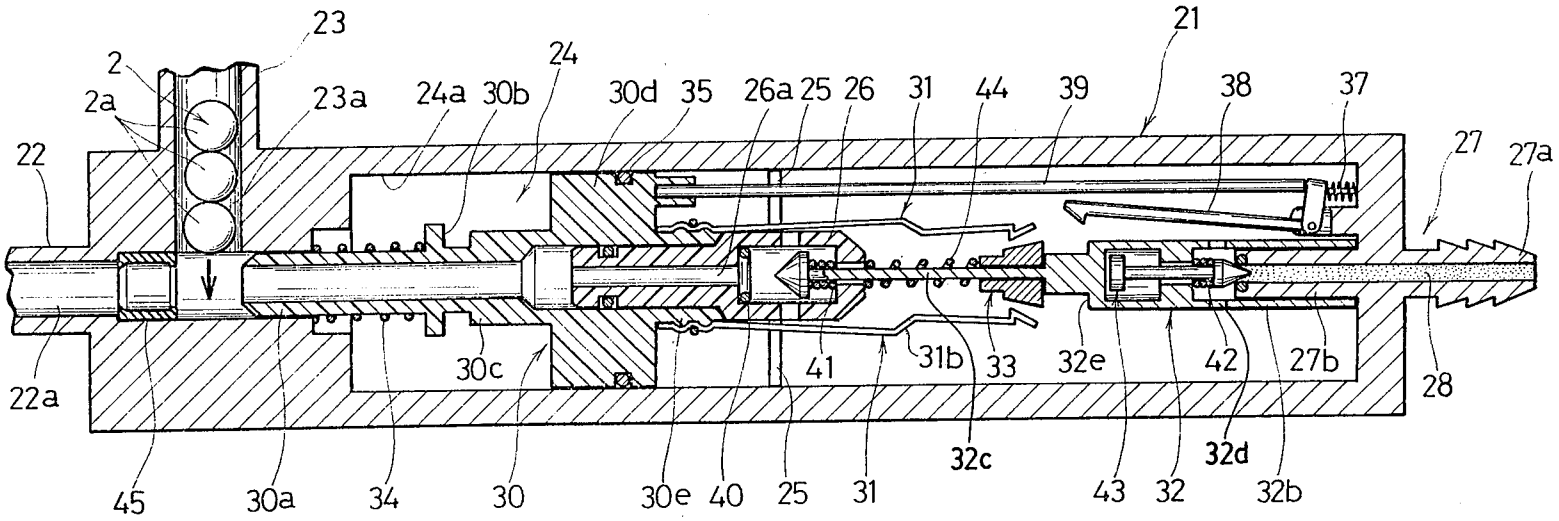
FIGS. 3 through 7 are cross-sectional views showing the essential parts of further embodiments according to the present invention which clearly illustrate the mode of operation.

FIG. 3 shows the initial condition of introduction of a bullet from the magazine into the barrel. At this time, the piston member 30 is retracted by sliding along the inner peripheral wall 24*a* of the chamber 24 under the influence of the first spring member 34. In this condition, the bullet introduction opening 23*a* is opened by retraction of the piston member 30. Thus, the bullet 2 now drops in front of the piston tip portion 30*a* and the rearward movement of the push rod 39 overcomes the spring member 37, which is associated with the locking piece 38. As a result, with reference to FIG. 5, the locking piece 38 rotates as indicated by the arrow, so that it is out of engagement with an engagement offset portion 32e formed at the central portion of the needle valve 32. Accordingly, the needle valve 32 begins advancing under the spring force of the second spring member 41.

As shown in FIG. 4, when the needle valve 32 advances as indicated by the arrow, the weight 33 also advances together against the spring force of a third spring member 44. In a short time, the weight 33 is held by the holding portions 31*a* of the hook arms 31, and the needle-like tip portion 32*a* of the first needle valve 32 is brought into contact with a ring 40 of the needle valve chamber to begin the sealing operation. Substantially at the same time, the seal valve 43 will release its sealing operation. Thus, the pressure medium begins flowing from the gas introduction hole 28 into the back side of the chamber section 24 through the notched portions 32*d*.

Figure 5:
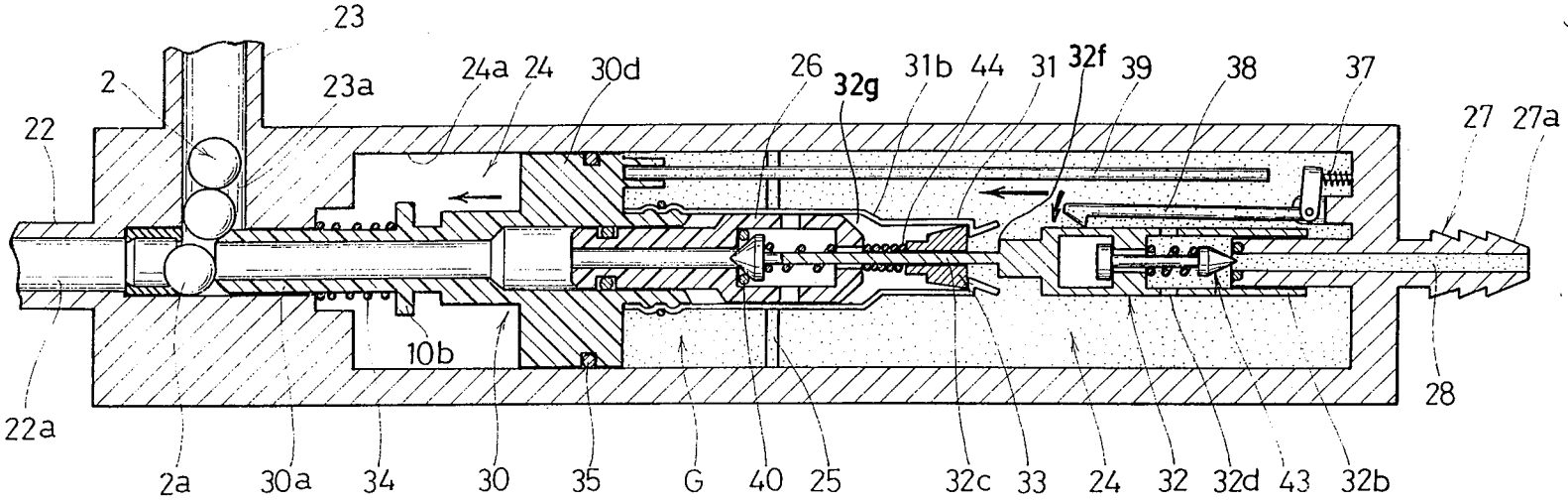

At that time, as illustrated in FIG. 5, the piston member 30 will now advance by reason of entrance of the pressure medium G against the spring force of the first spring member 32, at which time the push rod 39 is carried along, as indicated by the arrow. As a result, the rear end of the push rod 39 is moved away from the locking piece 38, with the result that the locking piece 38 is moved counterclockwise by force of the spring member 37. Thus, the piston member 30 advances further by the pressure medium G. At the same time when the bent portion 31*b* of the hook arm 31 comes into contact with an outer peripheral taper surface 32*g*, the next bullet 2*a* is now ready to be pushed by the tip portion of the piston member 30 into the packing member 45, preparatory for firing.

Figure 6:
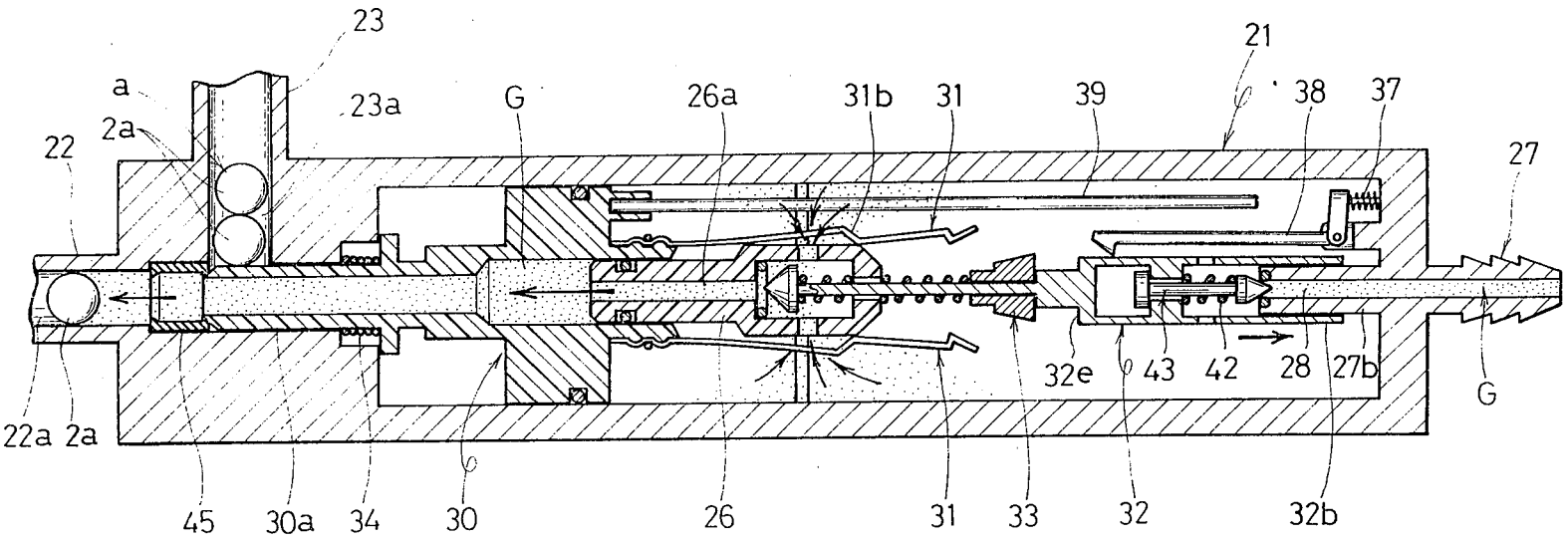

As shown in FIG. 6, the moment when firing is ready, the weight 33 is moved automatically out of engagement with the hook arms 31 of the piston member 30. At this time, the weight 33 hits against abutment 32*f*, thus moving the first needle valve 32 which seals the pressure medium G to thereby momentarily open the needle valve 32 and allow the inner tubular body 26 and the piston member 30 to pass the pressure medium G therethrough. As a result, the bullet 2*a* set in the packing member 45 is fired. Thus, when the weight 33 collides with the abutment 32*f* of the needle valve 32, the first needle valve 32 telescopes projection 27*b*, as indicated at the arrow. At that moment, the seal valve 43 seals the gas introduction hole 28. At this time, most of the energy given to the weight 33 is transmitted to the portion 32*b* of the needle valve 32, and the needle valve 32 is further withdrawn. Also, when sealing by the seal valve 43 is established, the pressure medium G attempts to push the seal valve 43 aside due to pressure thereon. However, since portion 32*b* of the needle valve 32 is further withdrawn, it continues to hold the seal valve 43 through the spring member 42, and there is no possibility for the pressure medium G to leak from the sealing portion.

Figure 7:
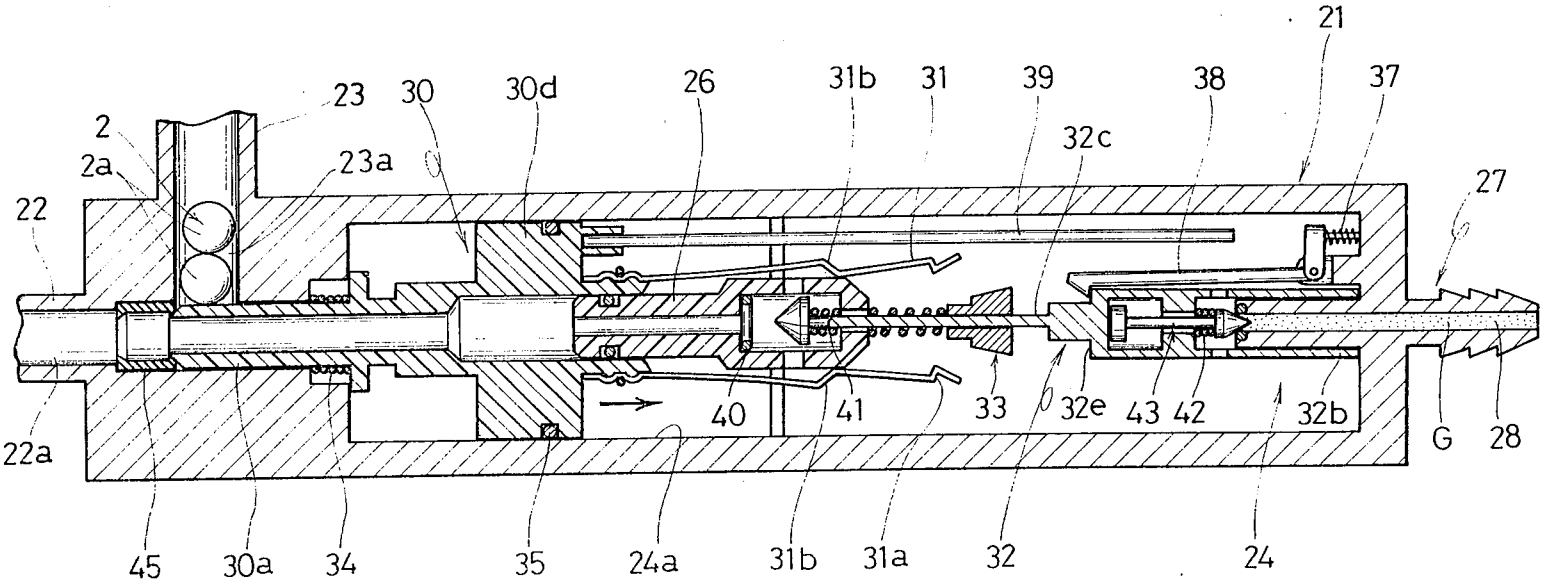

As now illustrated in FIG. 7, the needle valve 32 is further withdrawn due to an inertia force. As a result, at the same time as the spring member 42 is increasingly contracted and complete sealing is established, the locking piece 38 engages portion 32*e* by the spring member 37. Thus, the movement of the needle valve 32, which attempts to move forwardly by the force of the second spring member 41, is momentarily stopped. In such a condition, no new pressure medium G is permitted to flow into chamber 24. As a consequence, pressure within the outer tubular member 21 is discharged and the piston member 30 begins to return to its initial position, as can been seen in FIG. 3, by the force of the first spring member 34.

Figure 2:
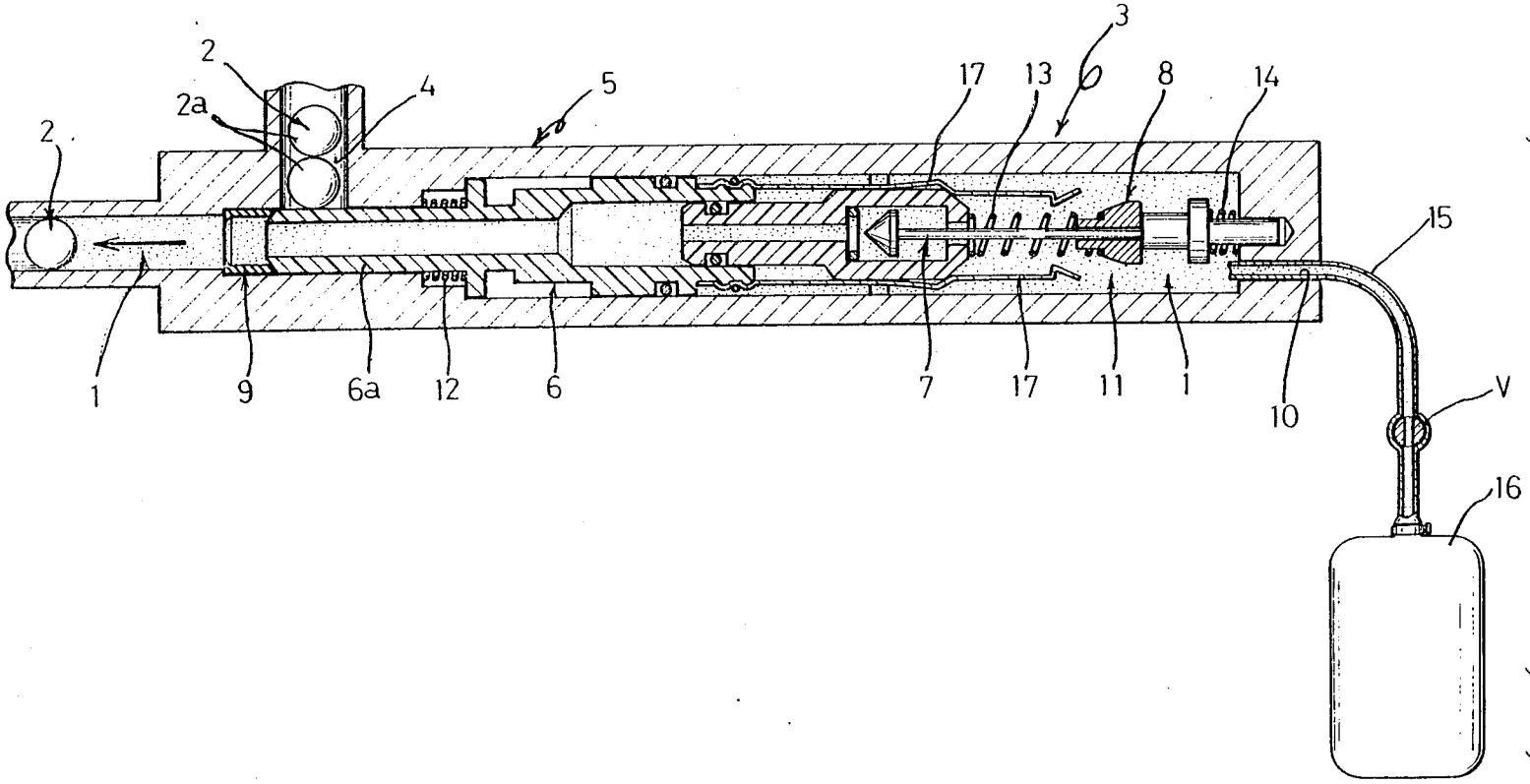
FIG. 2 is a cross-sectional view showing the essential parts of a device developed by myself which led to my invention.

Thus, when piston member 30 returns to its initial position, the push rod 39 also returns. As a result, the terminal end of the push rod 39 pushes the locking piece 38. This constitutes one entire cycle of operation. When the valve V shown in FIG. 2 is opened, the above-mentioned process will be repeated as long as the pressure medium G flows from the gas introduction hole 28 into the outer tubular member 21.

While it has been described in the embodiment of the present invention that the gas introduction section 27 is integrally formed with the back portion of the outer tubular member 21, it will be apparent to those skilled in the art that entry of the gas to the chamber can be achieved in various forms.

A different embodiment of the present invention will now be described. In the explanation of this embodiment, portions identical to those in the above-described embodiments are designated by the same reference numerals, respectively.

In this embodiment, an outer tubular member 21*a*, a bullet magazine 23A and a barrel 22A having passageway 22*a* are formed separately from each other and combined into a single body. Namely, the bullet magazine 23A is affixed to an end portion of the outer tubular member 21A by means of a plurality of screws 50, and the barrel 22A is screw-threadedly connected to the magazine. As explained earlier herein, a packing member 45A is positioned in close proximity to the barrel 22A.

Figure 8:
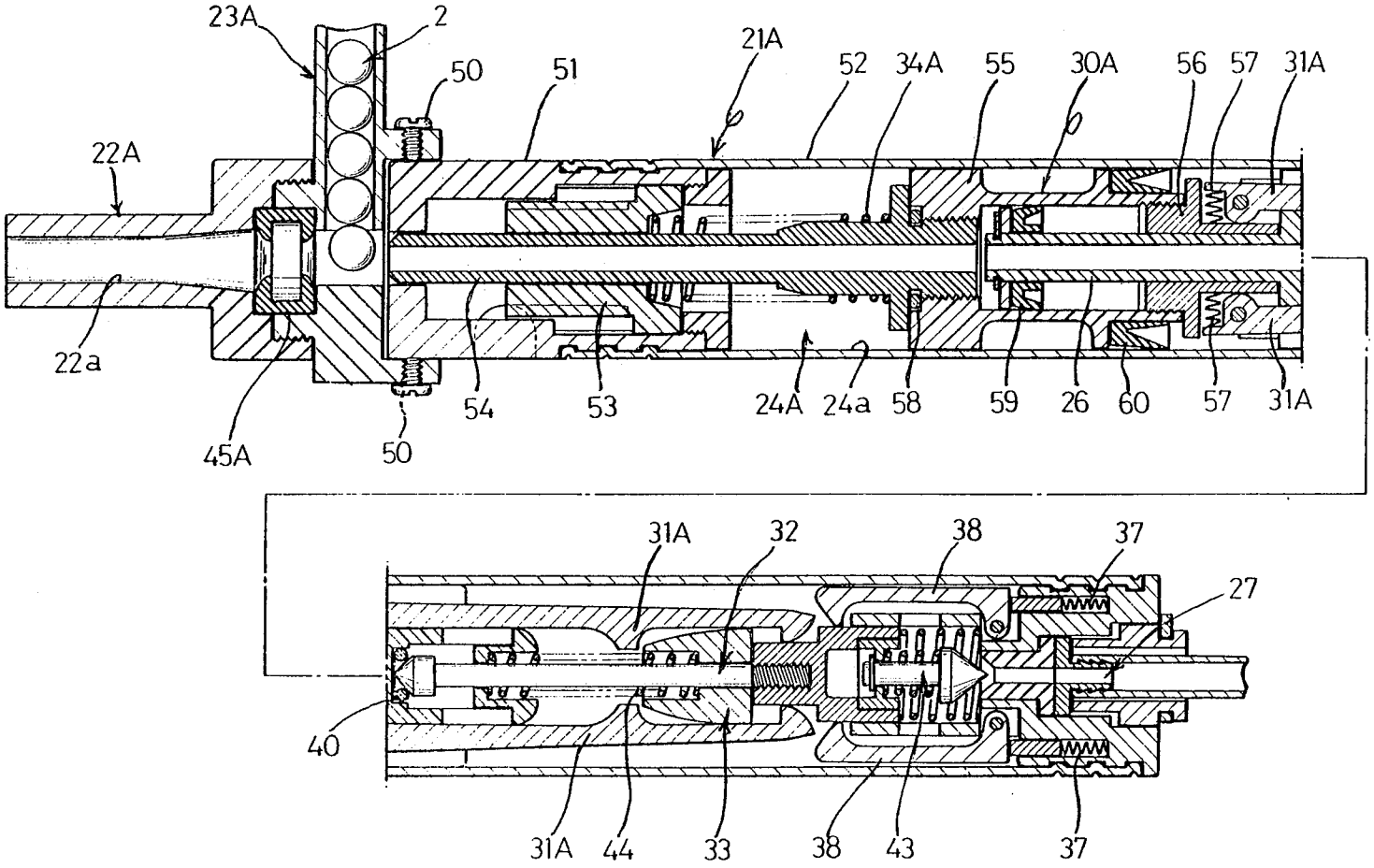
FIG. 8 is a cross-sectional valve showing the essential parts of a different embodiment.

The outer tubular member 21A and a piston member 30A are also divided into plural axially aligned sections, and these sections are combined into a single body. Namely, the outer tubular member 21A is divided into at least a tip portion 51 and a body 52. The tip portion is forcibly fitted into the body 52. A tubular spring adjustment member 53, capable of adjusting the spring force of a first spring member 34A, is screw-threadedly fitted into the tip portion 51. In addition, the piston member 30A is partitioned into a tip portion side 54, which slidably penetrates adjustment member 53. A large diameter slide portion 55 is screw-threadedly connected to the tip portion 54 side and is arranged to slide along an inner peripheral wall 24*a* of the chamber 24A. As shown in FIG. 8, a tubular fitting portion 56 is screw-threadedly connected to the large diameter slide portion 55. In addition, a plurality of hook arms 31A are pivotally mounted on portion 56. These hook arms 31A are biased in a closing direction by spring members 57. Packing members are used in this embodiment at 58, 59 and 60.

The foregoing relates to preferred exemplary embodiments of the invention, it being understood that other embodiments and variants thereof are possible within the spirit and scope of the invention, the latter being defined by the appended claims.

What is claimed is:

1. A device for shooting bullets by a pressure medium for use in a toy gun comprising;

an outer tubular member, said outer tubular member including a chamber section (24), a barrel (22) and a gas introduction section (27), a piston member fitted within said chamber section within said outer tubular member, said piston member is reciprocatable in response to changes in said pressure medium within said chamber section, an inner tubular body (26) fixedly provided within said piston member and includes a gas injection hole, a needle valve provided within a chamber within said inner tubular body so as to permit said gas injection hole of said inner tubular body to be opened and closed, a movable weight provided on said needle valve so that said weight can strike against said needle valve and be engaged or disengaged by a weight hook arm provided at said piston member, and a seal valve provided at the back end portion of said needle valve for momentarily closing a gas introduction hole in said gas introduction section in response to being struck by said weight.

2. A device for shooting bullets by a pressure medium for use in a toy gun as set forth in claim 1, which includes a locking piece (38) for holding said needle valve when said needle valve is withdrawn, said locking piece is provided within said chamber section of said outer tubular member and operated by a push rod (39) carried by said piston.

3. A device for shooting bullets by a pressure medium for use in a toy gun as set forth in claim 1, in which said piston includes a piston tip for partitioning a next bullet positioned at a bullet introduction opening in said outer tubular member when said piston member advances to close said bullet introduction opening.

4. A device for shooting bullets by a pressure medium for use in a toy gun as set forth in claim 1, wherein said outer tubular member, a bullet introduction member and said barrel are formed separately from each other, whereupon these members are combined with each other to form an operative body.

* * * * *